United States Patent [19]

Gartner

[11] Patent Number: 4,971,597

[45] Date of Patent: Nov. 20, 1990

[54] SOLID ALCOHOL FUEL WITH HYDRATION INHIBITING COATING

[75] Inventor: Scott Gartner, Baltimore, Md.

[73] Assignee: RA Investment Corporation, Baltimore, Md.

[21] Appl. No.: 281,672

[22] Filed: Dec. 9, 1988

[51] Int. Cl.[5] ..... C10L 7/00

[52] U.S. Cl. ..... 44/267; 44/313

[58] Field of Search ..... 44/7.1, 7.6, 7.4, 7.7

[56] References Cited

U.S. PATENT DOCUMENTS

| | | | |
|---|---|---|---|
| 2,613,142 | 10/1952 | Wiczer | 44/7.4 |
| 2,838,384 | 6/1958 | Sloan et al. | 44/7.4 |
| 3,072,467 | 1/1963 | Wiczer | 44/7.4 |
| 3,334,053 | 8/1967 | Audrieth et al. | 44/7.4 |
| 3,754,877 | 8/1973 | Klug | 44/7.4 |
| 3,824,085 | 7/1974 | Teng | 44/7.4 |
| 3,964,880 | 6/1976 | Siegrist | 44/7.4 |
| 4,141,766 | 2/1979 | Cameron et al. | 149/2 |
| 4,575,379 | 3/1986 | Browning | 44/7.4 |

*Primary Examiner*—Peter A. Nelson

*Attorney, Agent, or Firm*—Leitner, Greene & Christensen

[57] ABSTRACT

There is disclosed a process for making a solid alcohol fuel which comprises: (1) forming an aqueous slurry of an alcohol with a cellulosic derivative having a hydration inhibiting coating and (2) then adding an effective amount sufficient to increase the pH level above 8, of a caustic material so as to affect hydration and solidification. The preferred alcohols are ethanol and methanol, however alcohols having from one carbon to ten carbon atoms may be used. The caustic material is preferably sodium hydroxide or potassium hydroxide. The cellulosic derivative is typically a cellulose ether such as hydroxypropyl methyl cellulose. The hydration inhibiting coating on the cellulosic derivative is an acid coating or a glyoxylated surface. The composition further contains a smoke suppressant such as aluminium oxide trihydrate.

38 Claims, No Drawings

SOLID ALCOHOL FUEL WITH HYDRATION INHIBITING COATING

TECHNICAL FIELD OF THE INVENTION

This invention relates to methods of making solid alcohol fuels which process uses a cellulose derivative having a hydration inhibiting coating. This invention further relates to improved methods of making solid alcohol fuels which allows for in-situ production. Another aspect of the invention relates to solid alcohol fuel compositions which incorporate a cellulose derivative having a hydration inhibiting coating during the processing. A further aspect of the invention are solid alcohol fuels which do not produce any soot upon burning and therefore have more appeal to the consumer. The present invention further relates to in-situ formation of solid alcohol fuels.

BACKGROUND OF THE INVENTION

The present invention relates generally to combustible fuel compositions and is particularly directed to a fuel composition in the form of a solid gel for use in heating chafing dishes and the like, as flares, and for decorative lighting purposes.

A well-known, commercially available gel fuel widely used today is based on a lower molecular weight alcohol such as ethanol or methanol gelled by special, proprietary techniques with, e.g., nitrocellulose. While materials of this type have enjoyed considerable commercial success, there is room for improvement over them. One obvious shortcoming of the prior caustic is that they exhibit syneresis upon standing for an extended period of time. Thus, a freshly opened can of gelled fuel may contain a layer of free liquid alcohol on its surface which must be discarded prior to igniting the fuel or a hazardous flare-up will be experienced.

OBJECTS AND SUMMARY OF THE INVENTION

Accordingly, it is an object of the present invention to provide an improved fuel for heating and cooking.

It is another object of the present invention to provide a combustible fuel gel particularly adapted for heating chaffing dishes.

It is a further object of the present invention to provide a combustible fuel particularly adapted for use in cooking which has a controllable burn rate, and a wide range of flame characteristics.

Yet another object of the present invention is to provide a combustible fuel which offers minimal noxious combustion by-products and produces no soot and ashes.

A further object of the present invention is to provide a low cost, conveniently packaged and safe fuel gel.

A still further object of the present invention is to provide a combustible fuel in stable gel form which provides increased safety in storage, handling and use.

Another object of the present invention is to provide a high alcohol content combustible fuel in a stable gel form.

It is a further object of the present invention to provide a fuel composition adopted for indoor use which produces neither ashes nor smoke and is economical to use.

The present invention contemplates a combustible fuel comprised of alcohol, water and a cellulose derivative having a hydration inhibiting coating which is easily converted to gel form. The present invention further contemplates a process for making a solid alcohol fuel which comprises mixing an alcohol solution with a cellulose derivative having a hydration inhibiting coating so as to form a slurry and then adding an effective amount sufficient to increase the pH level above 8, of a caustic material so as to effect hydration and solidification. Various carbon alcohols containing one carbon to the carbon atoms, and combinations thereof, may be employed to provide a desired flame characteristic. Various salts may be added to similarly control flame color. In a preferred embodiment, a hydroxypropyl methyl cellulose having a hydration inhibiting coating such as an acid coating or a glyoxylated surface is utilized to provide a low cost flammable fuel which is stable and conveniently packaged, stored and handled.

The present invention further contemplates a solid alcohol fuel comprising: (1) an alcohol, (2) a cellulosic derivative having a hydration inhibiting coating; (3) a caustic material, and (4) a smoke suppressant such as alumina trihydrate.

The inhibition also provides an alcohol slurry conprising: (1) an alcohol; (2) a cellulosic derivative having a hydration inhibiting coating.

The invention further provides a process for the in-situ production of a solid alcohol fuel which comprises: (1) forming an aqueous slurry of an alcohol with a hydroxyl propyl methyl cellulose which has a hydration inhibiting coating and (2) placing the slurry into a receptacle having an effective amount of a caustic material to increase the pH of the resulting solid fuel to about 8 or above.

In the preferred embodiment of the present invention, the preferred alcohols are methanol and ethanol or combination thereof. The preferred cellulosic derivative is a hydroxypropyl methyl cellulose which has a hydration inhibiting coating such as an acid coat or a glyoxylated surface.

The appended claims set forth those novel features which characterize the invention. However, the invention itself, as well as further objects and advantages thereof, will best be understood by reference to the following detailed description of the preferred embodiments.

DETAILED DESCRIPTION OF THE PREFERRED EMBODIMENTS

The present invention is directed to a fuel composition and method of preparation therefor. The fuel is a combustible fuel particularly adopted for use in cooking, specifically chaffing dishes. The fuel can also be used for additional purposes such as heating and as a decorative light source.

The main chemical components of the present invention are alcohols, substituted cellulose derivatives, a caustic material and alumina trihydrate. The alcohols which are suitable for carrying out the present invention are straight chain, secondary or tertiary $C_1$–$C_{10}$ alcohols. Typical alcohols include methanol, ethanol, propanol, isopropanol, butanol, isobutyl alcohol, tertbutyl alcohol, pentanol, isopentyl alcohol, neopentyl alcohol, hexanol, heptanol, octanol, nonanol, and decanol as well as all possible positional isomers of the above alcohols. Cyclic alcohols such as cyclopropanol, cyclobutanol, cyclopentanol, cyclohexanol, cycloheptanol, cyclooctanol, cyclononanol and cyclodecanol can also be used in the present invention. The preferred alcohols for carrying out the present invention are the lower carbon alcohols such as methanol, ethanol, propanol and isopropanol.

The compositions of the present invention also contain a smoke suppressant. A typical smoke suppressant which is suitable for carrying out the present invention is alumina trihydrate. Other smoke suppressant materials can be interchanged with the alumina trihydrate and they include the alkali metal borates alone or in combination with ammonium sulfate, ammonium chloride and ammonium phosphate. Other materials such as the antimony oxide derivatives are also suitable. Aluminium trihydrate sold by Solene Industries under the trade designations of SB-30, Onyx Elite series, FRE, Micral 932, Micral 855, SB-805, SB-331/SB-332, SB-631/SB-632, SB-431/SB-432, SB-335/SB-336 and Micral 632 can all be used in the compositions and method of the present invention.

The cellulosic derivatives which are useful in carrying out the present invention are cellulosic alkyl ethers and hydroxyalkyl alkyl ethers. The cellulosic derivatives of the present invention have a special coating present on their surface which retards their hydration when mixed with the alcohol solution. A typical coating on the cellulose derivatives is an acid coating such as a polyacrylic acid coating. The cellulosic derivative can also be surface treated with glyoxal as shown in U.S. Pat. No. 3,072,635.

Typical cellulosic ether derivatives include methyl cellulose, ethyl cellulose, propyl cellulose and butyl cellulose. Among the preferred cellulose derivatives are the hydroxyalkyl alkyl celluloses. Typical hydroxyalkyl alkyl celluloses include hydroxypropyl methyl cellulose, hydroxyethyl ethyl cellulose, hydroxypropyl ethyl cellulose, hydroxyethyl methyl cellulose, hydroxypropyl propyl cellulose, hydroxyethyl propyl cellulose. The preferred cellulose derivative for carrying out the present invention is a hydroxypropyl methyl cellulose sold by the Dow Chemical Company under the name Methocel J75MS. The Methocel J75MS has a coating which inhibits hydration. The coating is of an acid nature or glyoxylated. The coating which inhibits the hydration allows for the manufacture of an all solid fuel in a fast and effective manner.

The hydroxypropyl methyl cellulose derivative of the present invention contains from about 5 to 12 percent by weight of hydroxypropoxy groups and from about 27 to 30 percent by weight of the cellulose ether. Advantageously, the cellulose ether derivative that is employed contains from about 7 to 12 percent by weight hydroxypropoxyl groups and from about 28 to 30 per cent by weight of methoxyl groups. Any viscosity grade of the cellulose ether that is available may be utilized satisfactorily. The preferred derivative is one sold by the Dow Chemical Company under the trade designation Methocel J75MS. The Methocel J75MS has a special coating which inhibits the hydration of the cellulosic derivative.

The preferred methocel material for carrying out the present invention is prepared by methods described in U.S. Pat. No. 3,072,635 and more specifically as shown in Examples 6 and 7 of the aforementioned patent. As shown in the '635 patent, the preferred materials for carrying out the present invention are glyoxylated with small amounts of glyoxal to give the cellulosic material easy dispensibility. The treatment with glyoxal also inhibits the hydration of the material until a caustic material is added so as to effect gelation of the alcohol fuel.

The cellulosic materials can also be treated with other $C_3$–$C_8$ dialdehydes as described above or can be coated with an acid material such as polymers having acidic groups. Polymers having acidic group can be derived from monomers such as acrylic or methacrylic acid and maleic acid and they can be copolymerized with other ethylenically unsaturated monomers by standard polymerization procedures well known in the prior art. A typical acid coating polymer would be polyacrylic acid.

The caustic material which is needed to start hydration can be any alkaline material which is effective to raise the pH to a level of 8 or above. Typical caustic materials include lithium hydroxide, sodium hydroxide, potassium hydroxide, cesium hydroxide, lithium carbonate, sodium carbonate, potassium carbonate, cesium carbonate, rubidium carbonate, calcium hydroxide, magnesium hydroxide, strontium hydroxide, strontium carbonate, barium hydroxide, barium carbonate, berillium carbonate or any other useful material which imparts alkalinity to the alcohol slurry.

In the process of the present invention, for example, 200 ml. of alcohol and 50 ml. of water are mixed first and then 10 grams of Methocel J75MS is added to obtain a very aqueous slurry, which stays aqueous for a long period because of the coating that is present in the Methocel. The coating material on the Methocel inhibits its hydration. To the above solution there is added an alkaline material to start hydration and to raise the pH level to 8 or above. The use of a specially treated cellulose derivative allows for solidification of the alcohol in individual cans. While the solution is still very aqueous it is poured into a can containing a caustic material and hydration and solidification occurs instantaneously. The process of the present invention avoids the problems of pumping and pouring which are associated with other cellulosic materials not having a hydration inhibiting coating.

The alcohol solution containing the cellulosic derivative having a hydration inhibiting coating solidifies immediately upon contact with the caustic material which has been placed in the can. No excess liquid remains after solidification.

The process of the present invention is carried out as follows: A solution containing 200 ml. of alcohol and 50 ml. of water is mixed with 10 grams of Methocel J75MS to form a fluid slurry and then the resulting slurry is placed into a receptacle having an effective amount of a caustic material to increase the pH of the resulting composition to about 8 or above. The amount of sodium hydroxide is typically 2 to 4 grams.

The solid fuels of the present invention typically contain 60–80% by weight alcohol, 5–35% by weight water, 1–4% by weight of the cellulosic derivative, and up to 1% of a smoke suppressant material such as alumina trihydrate.

EXAMPLES

Example 1

A solution containing 170 grams of isopropanol and 50 grams of water is mixed with 10 grams of Methocel J75MS. To the resulting slurry there is added 3 grams of sodium hydroxide wherein immediate gelation and hydration takes place.

Example 2

A solution containing 170 grams of methanol and 50 grams of water is mixed with 10 grams of Methocel J75MS. To the resulting slurry there is added 4 grams of sodium hydroxide wherein immediate hydration and solidification takes place.

Example 3

A solution containing 170 grams of isopropanol and 50 grams of water is mixed with 10 grams of Methocel J75MS. To the resulting slurry there is added 2 grams of sodium hydroxide wherein immediate hydration and solidification occurs.

Example 4

A masterbatch solution containing 1700 grams of ethanol and 500 of water is mixed with 100 grams of Methocel J75MS. The resulting slurry is quite fluid and is easily poured into individual cans (approximately 8-ounce containers) which contain 2–4 grams of sodium hydroxide. The solution hydrates and gels immediately upon contact. The cans are sealed and then ready for shipment.

Examples 5 to 8

Examples 1 through 4 are repeated as shown above except amounts ranging from 0.1% to 1% by weight of alumina trihydrate are added. The resulting solid alcohol fuels upon burning do not produce undesirable smoke or unpleasant odors.

The present invention thus provides an improved fuel composition and method of preparation therefor. The gel form of the fuel composition of the present invention offer various advantages such as retarding of fuel evaporation particularly with respect to alcohol-based fuels, increased safety due to elimination of spill hazards, and a controllable burn rate as determined by the amount of alcohol in the fuel. Reduced amounts of alcohol will result in lower combustion temperatures and reduced burn rates. In addition, the present invention provides a fuel in gel form having a uniform viscosity throughout which also ensures a more uniform burn rate throughout combustion of the entire fuel sample. The addition of alumina trihydrate further eliminates undesirable smoke and unpleasant odors.

What is claimed and desired to be secured by this patent of the United States is:

1. A process for preparing a solid alcohol fuel which comprises: mixing an alcohol solution with a cellulose derivative having a hydration inhibiting coating thereby forming a slurry and then adding an effective amount sufficient to increase the pH level above 8, of a caustic material so as to effect hydration and solidification.

2. A process according to claim 1 wherein the cellulosic derivative is a cellulose ether.

3. A process according to claim 2 wherein the cellulose ether is selected from the group consisting of methyl cellulose, ethyl cellulose and propyl cellulose.

4. A process according to claim 1 wherein the cellulosic derivative is a hydroxyalkyl alkyl cellulose.

5. A process according to claim 4 wherein the cellulosic derivative is hydroxypropyl methyl cellulose.

6. A process according to claim 5 wherein the hydroxypropyl methyl cellulose has 5 to 12 per cent by weight of hydroxypropoxy groups and from about 27 to 30 per cent by weight of methoxy groups, based on the weight of the cellulose ether.

7. A process according to claim 1 wherein the alcohol is selected from the group of straight chain $C_1$–$C_{10}$ alcohols.

8. A process according to claim 7 wherein the alcohol is selected from the group consisting of methanol, ethanol, propanol and butanol.

9. A process according to claim 1 wherein the alkaline material is selected from the group consisting of sodium hydroxide and potassium hydroxide.

10. A process according to claim 1 wherein the hydration inhibiting coating on the cellulosic derivative is of an acid nature or a glyoxylic coating.

11. A process according to claim 1 wherein the hydration inhibiting coating reacts instantaneously with said caustic material.

12. A process according to claim 11 wherein the hydration inhibiting coating reacts with the caustic material to instantaneously form a solid alcohol fuel.

13. A process for the instantaneous production of a solid alcohol fuel which comprises: (1) forming slurry of a liquid alcohol with a cellulosic derivative having a hydration inhibiting coating and (2) placing the slurry into a receptacle having an effective amount of a caustic material to increase the pH of the resulting solid fuel to about 8 or above.

14. A process for the in-situ production of a solid alcohol fuel which comprises: (1) forming an aqueous slurry of an alcohol with a hydroxypropylmethyl cellulose which has a hydration inhibiting coating and (2) placing the slurry into a receptable having an effective amount of a caustic material to increase the pH of the resulting solid fuel to about 8 or above.

15. A process according to claim 14 wherein the alcohol is selected from the group consisting of methanol and ethanol.

16. A process according to claim 15 wherein the caustic material is sodium hydroxide.

17. A solid alcohol fuel comprising:

(1) an alcohol;

(2) a cellulosic derivative having a hydration inhibiting coating; and (3) an alkaline material.

18. An alcohol slurry comprising:

( (1) an alcohol; and (2) a cellulosic derivative having a hydration inhibiting coating.

19. The solid fuel of claim 17 wherein the alcohol is methanol.

20. The solid fuel of claim 17 wherein the alcohol is ethanol.

21. The solid alcohol fuel of claim 17 wherein the cellulose derivative is hydroxypropyl methyl cellulose.

22. The solid alcohol fuel of claim 17 wherein the alkaline material is sodium hydroxide.

23. The slurry of claim 18 wherein the alcohol is methanol.

24. The slurry of claim 18 wherein the alcohol is ethanol.

25. The slurry of claim 18 wherein the alcohol is methanol.

26. The solid alcohol fuel produced by the method of claim 1.

27. The solid alcohol fuel produced by the method of claim 13.

28. The solid alcohol fuel produced by the method of claim 14.

29. The composition of claim 17 produced the method of claim 1.

30. The composition of claim 17 produced by the method of claim 13.

31. The composition of claim 17 produced by the method of claim 14.

32. The composition of claim 17 wherein the hydration inhibiting coating is an acid coating.

33. The slurry of claim 18 wherein the hydration inhibiting coating is an acid coating.

34. A composition comprising an aliphatic alcohol having from one to ten carbon atoms and containing an effective amount of a cellulose derivative having a hydration inhibiting coating.

35. A solid alcohol fuel comprising:
(1) an alcohol;
(2) a glyoxylated cellulose derivative; and
(3) an alkaline material.

36. The fuel of claim 35 further including an effective amount of a smoke suppressant.

37. The fuel of claim 36 wherein the smoke suppressant is alumina trihydrate.

38. An alcohol slurry comprising:
(1) an alcohol; and
(2) a glyoxylated cellulose derivative.

* * * * *